United States Patent [19]

Sloan

[11] 4,096,710

[45] Jun. 27, 1978

[54] FOOT JEWELRY

[76] Inventor: Betty Jeanne Sloan, 33915 Calle Acordarse, San Juan Capistrano, Calif. 92675

[21] Appl. No.: 759,486

[22] Filed: Jan. 14, 1977

Related U.S. Application Data

[63] Continuation-in-part of Ser. No. 676,711, Apr. 14, 1976, abandoned.

[51] Int. Cl.[2] ..... A44C 25/00

[52] U.S. Cl. ..... 63/2; 63/15

[58] Field of Search ..... 63/2, 15, 15.5, 31; 128/81 R

[56] References Cited

U.S. PATENT DOCUMENTS

| | | | |
|---|---|---|---|
| 922,212 | 5/1909 | Tropin | 63/31 |
| 2,471,997 | 5/1949 | Baltor | 128/81 R |
| 3,688,520 | 9/1972 | Strassel | 63/15 |

FOREIGN PATENT DOCUMENTS

| | | | |
|---|---|---|---|
| 1,051,935 | 9/1953 | France | 63/15 |
| 509,909 | 8/1920 | France | 63/31 |
| 500,021 | 11/1954 | Italy | 63/2 |

*Primary Examiner*—F. Barry Shay
*Attorney, Agent, or Firm*—Gordon L. Peterson

[57] ABSTRACT

An ornamental ring removably attachable to at least two adjacent toes including an ornament and an attachment device for attaching the ornament to the two adjacent toes. The attachment device includes first and second hooks and each of the hooks includes a stem and a toe embracing section. The attachment device mounts the ornament on the stems with the stems projecting away from the ornament in generally the same direction. The toe embracing sections are joined to the stems respectively and extend away from each other so that the toe embracing sections can embrace the two adjacent toes, respectively. Each of the toe embracing sections is adapted to extend circumferentially less than 360°. At least substantial portions of the toe embracing sections are offset from each other in a direction generally axially of the toes.

10 Claims, 9 Drawing Figures

FOOT JEWELRY

BACKGROUND OF THE INVENTION

This application is a continuation-in-part of copending application Ser. No. 676,711 filed on Apr. 14, 1976, and entitled FOOT JEWELRY, now abandoned.

This invention relates to jewelry of the type which can be worn on the fingers or toes, but is particularly adapted for wearing on the toes. As is well known, the common finger ring is put on or worn by simply slipping the ring onto a finger. Because of the shape and function of the toes, it is not possible to wear an ornamental ring on a toe in the same manner.

Italian Pat. No. 500,021 shows an ornamental ring adapted to be worn on the foot. The ornamental ring is attached to adjacent toes by a pair of hooks which substantially encircle the adjacent toes. The configuration of the hooks makes this device difficult to put on. In addition, the hooks do not attach the ornamental ring to the toes as securely as desired.

SUMMARY OF THE INVENTION

The present invention provides an ornamental ring which can be worn on adjacent digits; i.e., fingers or toes; however, it is particularly adapted to be worn on adjacent toes. The ornamental ring of this invention is easy to put on and securely attaches the ring to the toes without causing any discomfort to the wearer. After being put in position, the ornamental ring will not inadvertently come off.

The secure attachment is obtained by attaching the ornamental ring to adjacent toes using a pair of hooks, at least portions of which are offset axially; i.e., axially of the hooks. As the inner ends or the bases of the toes generally recede from the largest toe toward the smallest toe, this axial offset enables each of the hooks to engage the associated toe closely adjacent its base. This materially contributes to a secure, tight attachment.

The ornamental ring of the present invention is made easier to put on and take off by appropriately limiting the circumferential extent of each of the hooks. Because of the secure attachment provided by the present invention, the circumferential extent of the hooks can be reduced without loosening the attachment of the ring to the toes. The reduction in circumferential extent of the hooks also allows the ornamental ring to be worn without discomfort.

These features can be advantageously embodied in an ornamental ring which includes an ornament and attachment means for attaching the ornament to two adjacent toes. The attachment means includes first and second hooks and each of the hooks may also include a stem and a digit or toe embracing section. The attachment means also includes means for mounting the ornament on the hooks with the hooks projecting away from the ornament in generally the same direction. The toe embracing sections are joined to the stems, respectively, and extend away from each other so that the toe embracing sections can embrace the two adjacent toes, respectively. To provide a secure attachment, at least substantial portions of the toe embracing sections are offset from each other in a direction generally axially of the hooks.

Although the attachment means can include multiple members, construction is simplified if it includes an integral wirelike element which defines the hooks. The wire-like element also preferably includes a reverse bend portion integrally joining the first and second hooks. The reverse bend portion can also be used to axially offset the toe embracing sections by axially offsetting the first and second hooks and to attach the hooks to the ornament.

The two adjacent toes to which the ring is to be attached, may be considered as having confronting sides which confront each other and remote sides which are relatively remote from each other. With the ornamental ring mounted on these two toes, the stems are between the confronting sides. As viewed in end elevation, one of the toes may be considered to have a three o'clock position on the confronting side thereof, a nine o'clock position on the remote side thereof, and a six o'clock position half way between the three o'clock and the nine o'clock positions.

In order to provide a secure attachment, the toe embracing section which embraces such toe should be adapted to extend to at least about the six o'clock position. However, for maximum wearer comfort and to facilitate putting the ornamental ring on and taking it off, the toe embracing section should preferably not extend beyond the nine o'clock position.

For a ring which is to be worn on the toes, a relatively large ornament which projects rearwardly over the forward portion of the foot may cause discomfort due to the ornament cutting into, or rubbing against, this portion of the foot. The reason for this is that the upper surface of the portion of the foot immediately adjacent the base of the toes characteristically rises upwardly above the toes. Accordingly, if the ornament projects rearwardly, it tends to irritate the foot of the wearer.

One approach to the problem is to simply elevate the entire ornament. Unfortunately, this materially increases the likelihood of catching the ornament on some object, and the increased height of the ornament increases the mechanical advantage in applying this force to the toes of the wearer. Consequently, increasing the height of the ornament correspondingly increases the likelihood of injury.

With this invention, mounting means mounts the ornament on the hooks so that the ornament is inclined upwardly as it extends rearwardly from the mounting means when the ring is on at least two digits of the wearer. The inclination is sufficient to avoid the foot irritation problem noted above. In addition, the overall height of the ring is not increased, and accordingly, the likelihood of injury is not increased.

The necessary upward inclination of the ornament can be obtained in various different ways. For example, the ornament may be rigidly mounted in position at an angle so that it extends upwardly at the desired angle. Alternatively, the ornament may be mounted for limited pivotal movement about an axis which extends generally transverse to the axes of the hooks. In this event, the ornament can extend upwardly from its mounting means when the ring is being worn. In either event, the desired inclination can be obtained.

The invention, together with further features and advantages thereof, can best be understood by reference to the following description taken in connection with the accompanying illustrative drawing.

DESCRIPTION OF THE PREFERRED EMBODIMENT

Figure 1:
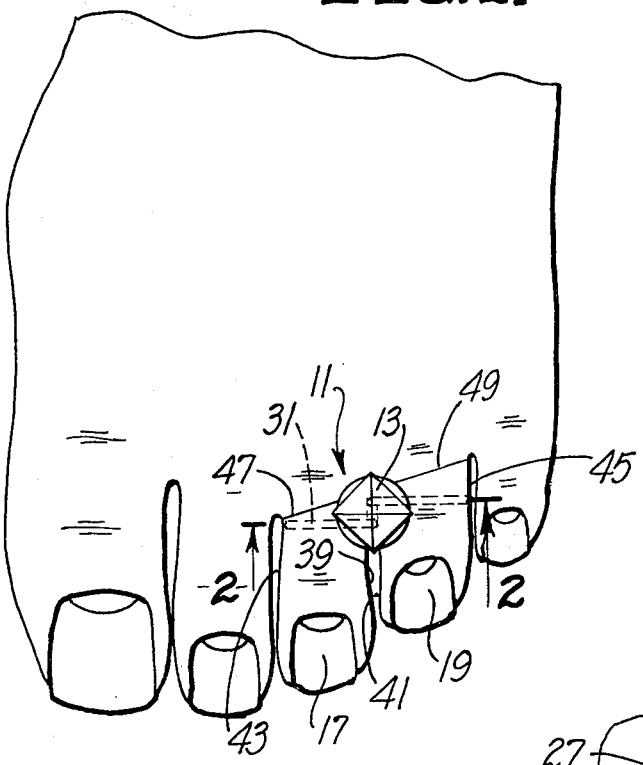
FIG. 1 is a fragmentary plan view of an ornamental ring on the foot of a wearer.

FIGS. 1–4 of the drawing show an ornamental ring 11 constructed in accordance with the teachings of this invention and generally including an ornament 13 and attachment means 15 for attaching the ornamental ring to adjacent toes 17 and 19. The ornament 13 can be of various sizes, configurations and materials, and the particular features of the ornament form no part of this invention. In the embodiment illustrated, the ornament 13 is in the form of a precious stone; however, the ornament 13 may also be constructed of inexpensive materials.

The attachment means 15 includes first and second hooks 21 and 23. Although the hooks 21 and 23 may be separate, discrete elements, in the embodiment illustrated, they are formed from an integral bendable, wire-like element, which wire-like element also includes a reverse bend portion 25 integrally joining the hooks 21 and 23. The wire-like element may be formed of various different materials such as metal or plastic and may be of various different cross-sectional configurations including a round cross section or a flat cross section. However, the surfaces of the hooks 21 and 23 which contact the toes 17 and 19 should be smooth for maximum wearer comfort.

More specifically, the hooks 21 and 23 include stems 27 and 29, respectively, with the stems being attached to the ornament 13 and projecting away from the ornament in generally the same direction. The hooks 21 and 23 also include toe or digit embracing sections 31 and 33, respectively. The toe embracing sections 31 and 33 are integrally joined to the stems 27 and 29 respectively and extend generally away from each other so that the toe embracing sections can embrace the associated toes 17 and 19.

Figure 3:
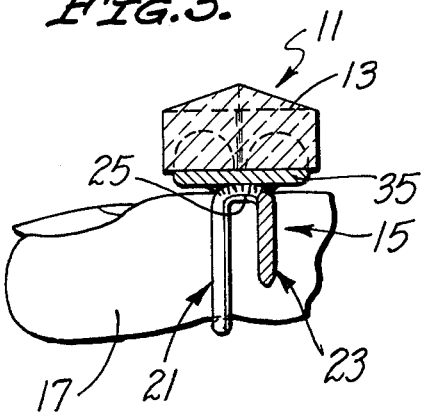
FIG. 3 is a fragmentary sectional view taken generally along line 3—3 of FIG. 2.
Figure 4:
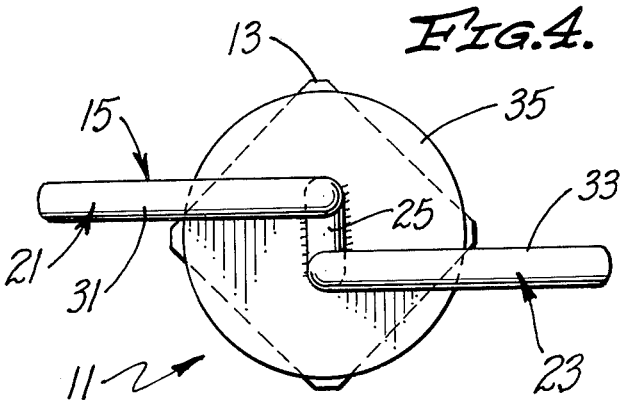
FIG. 4 is a bottom plan view of the ornamental ring.

The toe embracing sections 31 and 33 are offset from each other in a direction generally axially of the hooks 21 and 23. The axes of each of the hooks 21 and 23 may be considered as extending in a direction perpendicular to the planes defined by the hooks 21 and 23, respectively. Specifically, for arcuate digit embracing sections 31 and 33, the axes may extend through the centers of such arcs, respectively. It should also be noted that the hooks 21 and 23 define planes which are offset in a direction generally transverse to the planes. Although this offset could be brought about in different ways, in the embodiment illustrated, it is obtained by the reverse bend portion 25 as best shown in FIGS. 3 and 4. Although various different configurations can be used, in the embodiment illustrated, each of the toe embracing sections 31 and 33 is arcuate and extends circumferentially for substantially less than 360°.

The hooks 21 and 23 can be attached to the ornament 13 in many different ways. By way of illustration and not by way of limitation, this can be accomplished by suitably affixing the reverse bend portion 25 to a platform or base 35 and by attaching the ornament to the base with bendable prongs or tabs 37.

Although the ornamental ring 11 can be worn on the fingers, it is shown in the drawing as being attached to the adjacent toes 17 and 19. It will be noted in this connection that the toes 17 and 19 have confronting sides 39 and 41 and remote sides 43 and 45. In addition, toes 17 and 19 have inner ends or bases 47 and 49, respectively, with the base 49 being further inwardly on the foot than the base 47.

Figure 2:
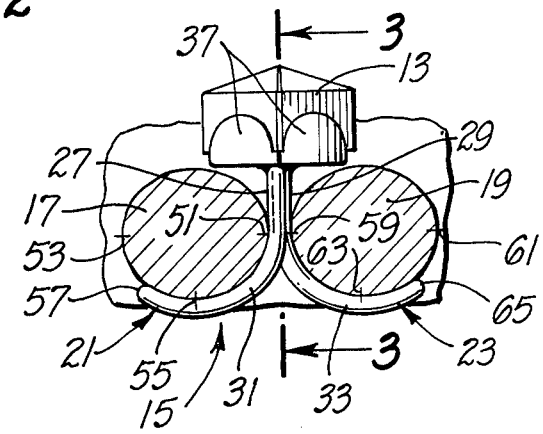
FIG. 2 is an enlarged, fragmentary sectional view taken generally along line 2—2 of FIG. 1.

The ornamental ring 11 can be put on by slipping the stems 27 and 29 between the confronting sides 39 and 41 and then moving the ornamental ring upwardly slightly to seat the toe embracing sections 31 and 33 against the toes 17 and 19 as shown in FIG. 2. Because of the axial offset provided by the reverse bend portion 25, the toe embracing sections 31 and 33 fit closely adjacent the inner ends 47 and 49 of the toes 17 and 19. With the toe embracing sections 31 and 33 seated firmly against the inner ends 47 and 49, a much more secure attachment of the ornamental ring to the toes is obtained. This is made possible by the axial offset of the toe embracing sections 31 and 33.

From FIG. 2 it can be seen that the toe embracing sections 31 and 33 extend only part way around the toes 17 and 19, respectively. More specifically, the toe 17 has, as viewed in end elevation or cross section (FIG. 2), a three o'clock position 51 on the confronting side 39, a nine o'clock position 53 on the remote side 43, and a six o'clock position at the bottom halfway between the three o'clock and nine o'clock positions.

The toe embracing section 31 has an end 57 which terminates between the nine o'clock position 53 and the six o'clock position 55. Similarly, the toe 19 has a nine o'clock position 59 on the confronting side 41, a three o'clock position 61 on the remote side 45, and a six o'clock position 63 at the bottom half-way between the nine o'clock and three o'clock positions. The toe embracing section 33 has an end 65 which terminates between the three o'clock position 61 and the six o'clock position 63.

To assure that the ring 11 is securely mounted on the toes 17 and 19, the toe embracing sections 31 and 33 preferably extend clockwise and counter-clockwise, respectively, to at least about the six o'clock positions 55 and 63. However, to facilitate putting the ring 11 on and taking it off and for maximum wearer comfort, the toe embracing sections 31 and 33 preferably do not extend circumferentially clockwise and counterclockwise, respectively, beyond about the nine o'clock position 53 and the three o'clock position 61.

FIGS. 5–8 show an ornamental ring **11*a* which is identical to the ornamental ring 11 in all ways not specifically shown or described herein. Portions of the ornamental ring 11*a* corresponding to portions of the ornamental ring 11** are designated by corresponding reference numerals followed by the letter *a*.

A basic difference between these embodiments is that the ornament **13*a* is larger than the ornament 13, and it extends upwardly (FIG. 7) as it extends rearwardly of the reverse bend portion 25*a*. The ornament 13*a* has a rear edge 101 which, because of the incline of the ornament, does not irritate the wearer's foot 103**.

Figure 7:
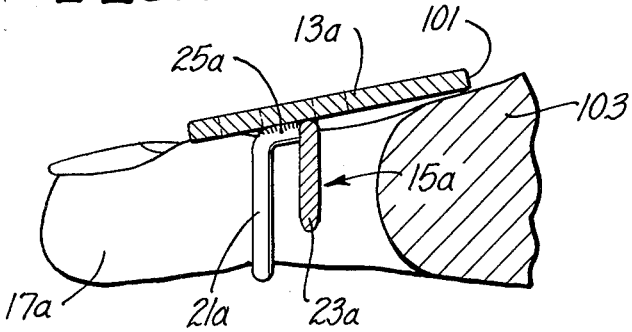
FIG. 7 is a fragmentary sectional view taken generally along line 7—7 of FIG. 6.

More particularly, the ornament 13a, like the ornament 13, may be of various different configurations, and the configuration shown in FIGS. 5–8 is merely illustrative. However, the feature of inclining the ornament 13a is particularly adapted for use with an ornament which extends rearwardly toward and/or over a forward portion of the foot 103. Although the incline of the ornament 13a can be brought about in various different ways, in the embodiment illustrated, it is simply and inexpensively obtained by inclining the reverse bend portion 25a so that it extends upwardly as it extends rearwardly toward the foot 103 (FIG. 7). The ornament 13a is mounted directly on the reverse bend portion 25a in any suitable manner. Accordingly, the ornament 13a is inclined at approximately the same angle as the reverse bend portion 25a. The angle of the incline may vary, but may, for example, 10°–15°.

In the embodiment of FIGS. 5–8, the base 35 and the tabs 37 of the embodiment of FIG. 1–4 are eliminated. The reverse bend portion 25a axially offsets the hooks 21a and 23a in the same manner as described above in connection with FIGS. 1–4.

Figure 5:
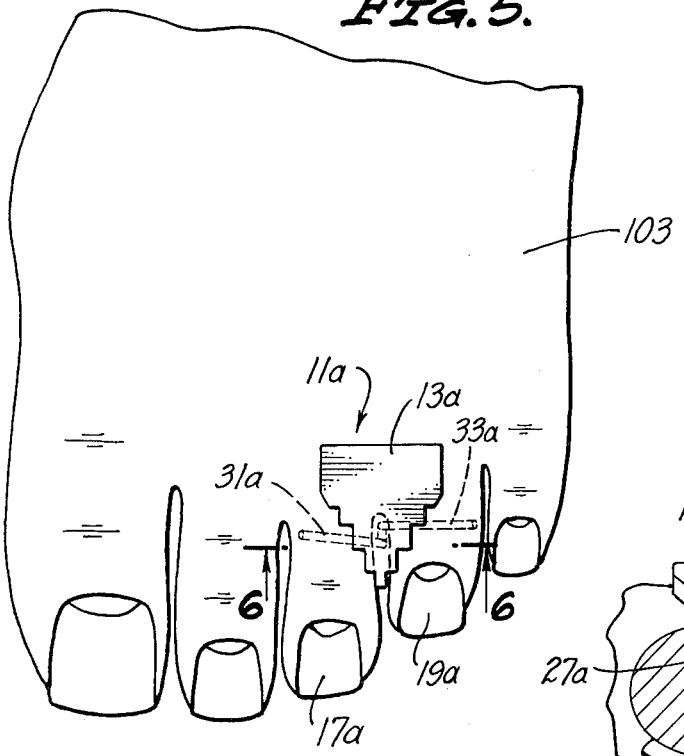
FIG. 5 is a plan view similar to FIG. 1 illustrating a second embodiment of the invention.
Figure 6:
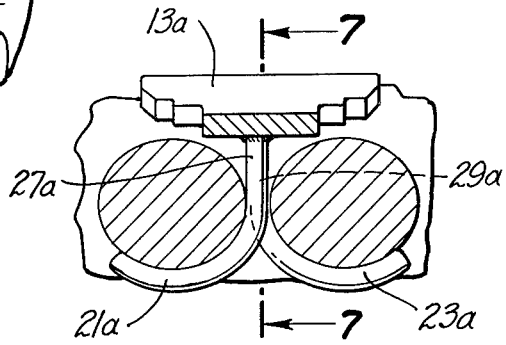
FIG. 6 is a sectional view taken generally along line 6—6 of FIG. 5.
Figure 8:
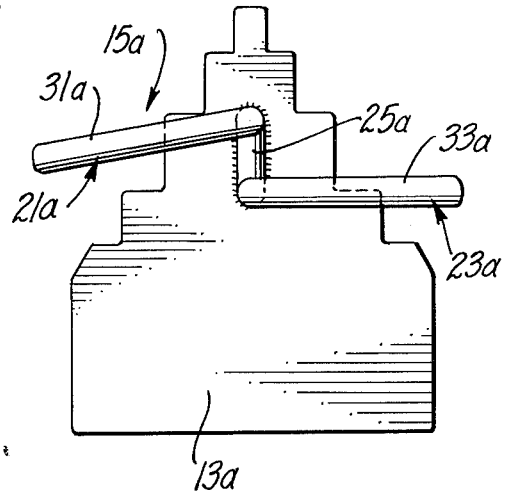
FIG. 8 is a bottom plan view of the ornamental ring.

The ornament 13a is attached to adjacent toes 17a and 19a by attachment means 15a in substantially the same manner as described above in connection with FIGS. 1–4. Except for the incline of the reverse bend portion 25a, the attachment means 15a may be identical to the attachment means 15. However, as best shown in FIGS. 5 and 8, the digit embracing section 31a has been bent into a position so that it is not parallel with the digit embracing section 33a. Because the wire-like element from which the hooks 21a and 23a are constructed is bendable, the particular configuration of the hooks can be readily changed to meet the requirements of the wearer. To illustrate this, the digit embracing section 31a has been bent to a position in which it is nonparallel with the digit embracing section 33a.

Figure 9:
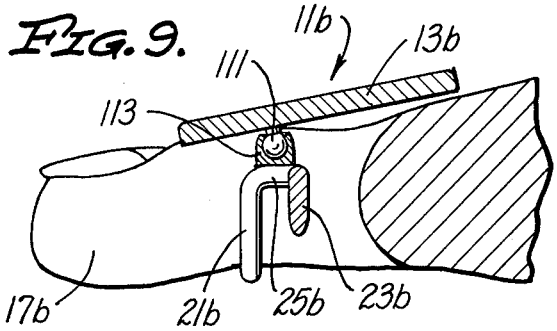
FIG. 9 is a fragmentary sectional view similar to FIG. 7 illustrating a third embodiment of the invention.

FIG. 9 shows an ornamental ring 11b which is identical to the ornamental ring 11 in all respects not specifically shown or described herein. Portions of the ornamental ring 11b corresponding to portions of the ornamental ring 11 are designated by corresponding reference numerals followed by the letter *b*.

The primary difference between the rings 11 and 11b is that the ornament 13b is relatively large and may be identical to the ornament 13a (FIGS. 5–8), and the ornament is mounted on the reverse bend portion 25b by a ball 111 and a socket 113. This mounts the ornament 13b for limited pivotal movement relative to the reverse bend portion 25b.

More particularly, in the embodiment illustrated, the socket 113 is suitably mounted on the reverse bend portion 25b and the ball 111 is mounted on the underside of the ornament 13b. The friction between the ball 111 and the socket 113 should be sufficient so that the ornament 13b does not freely wobble.

The purpose for the pivotal mounting of the ornament 13b is to allow the ornament 13b to be inclined upeardly as it extends rearwardly from the reverse bend portion 25 when the ornamental ring 11b is mounted on the toe 17b and the adjacent toe (not shown in FIG. 9). With this construction, the particular configuration of the wearer's foot determines the proper angle of inclination for the ornament 13b. Furthermore, this angle can be changed as the foot and toes move.

The ball 111 and the socket 113 mount the ornament 13b for pivotal movement about an infinite number of pivotal axes. However, it is only necessary that the ornament 13b be pivotal about an axis which extends generally transverse to the axes of the hooks 21b and 23b and/or of the toes. Accordingly, the ball 111 may be replaced by a cylindrical pin and the socket 113 may be correspondingly shaped so as to mount the ornament 13b for pivotal movement only about such a transverse axis.

The ornament 13b is attached directly to the reverse bend portion 25b without the platform 25 and the tabs 37 shown in the embodiment of FIGS. 1–4. The hooks 21b and 23b are axially offset by the reverse bend portion 25b in the same manner described above with reference to FIGS. 1–4.

Although an exemplary embodiments of the invention have been shown and described, many changes, modifications and substitutions may be made by one having ordinary skill in the art without necessarily departing from the spirit and scope of this invention.

I claim:

1. An ornamental ring removably attachable to at least two adjacent digits comprising:

an ornament;

attachment means for attaching the ornament to the two adjacent digits;

said attachment means including a wire-like element including first and second hooks and a reverse bend portion;

each of said hooks having an inner end and an outer end, said reverse bend portion joining said hooks at said inner ends;

each of said hooks including a digit embracing section;

said attachment means including means for mounting said ornament on said reverse bend portion of said hooks with said hooks being on the same side of said ornament;

said digit embracing sections extending generally away from each other so that said digit embracing sections can embrace the two adjacent digits, respectively, each of said digit embracing sections extending circumferentially for less than 360°; and said reverse bend portion offsetting said inner ends of said hooks and at least substantial portions of said digit embracing sections in a direction generally axially of the hooks.

2. An ornamental ring as defined in claim 1 wherein said wire-like element is bendable.

3. An ornamental ring as defined in claim 1 wherein said mounting means mounts the ornament so that it is inclined upwardly as it extends rearwardly from the mounting means and downwardly as it extends forwardly from the mounting means when the ornamental ring is on the two digits.

4. An ornamental ring as defined in claim 1 wherein said two adjacent digits have confronting sides which confront each other and remote sides which are relatively remote from each other, each of said hooks includes a stem terminating in said inner end of the associated hook between said confronting sides when the ornamental ring is attached to the two digits, one of the digits has a three o'clock position on the confronting side thereof, a nine o'clock position on the remote side thereof, and a six o'clock position halfway between said three o'clock position and said nine o'clock position as such digit is viewed in end elevation, the digit embracing section which embraces said one digit being adapted to extend no farther around the remote side of said one digit than about said nine o'clock position.

5. An ornamental ring as defined in claim 4 wherein the digit embracing section which embraces said one digit is adapted to extend to at least about said six o'-clock position.

6. An ornamental ring as defined in claim 5 wherein at least portions of each of said digit embracing sections are arcuate.

7. An ornamental ring as defined in claim 1 wherein said mounting means mounts the ornament on the reverse bend portion for limited pivotal movement about an axis which extends generally transverse to the axes of the hooks.

8. An ornamental ring as defined in claim 1 wherein said mounting means mounts the ornament on said reverse bend portion at an angle so that the ornament extends upwardly as it extends rearwardly of the mounting means.

9. An ornamental ring as defined in claim 1 wherein said reverse bend portion is inclined upwardly as it extends rearwardly to thereby incline the ornament upwardly as it extends rearwardly of the reverse bend portion.

10. An ornamental ring as defined in claim 1 wherein said reverse bend portion extends generally axially between said inner ends of said hooks and integrally joins said inner ends of said hooks.

* * * * *